US005981861A

United States Patent [19]

Van Delinder et al.

[11] Patent Number: 5,981,861

[45] Date of Patent: Nov. 9, 1999

[54] ELECTRO-MECHANICALLY DRIVEN SOUND BOARD

[76] Inventors: David B. Van Delinder, 155 Lord St., Elgin, Ill. 60123; Bruce E. Petros, 345 County Rd. CE, Kaukauna, Wis. 54130

[21] Appl. No.: 08/993,584

[22] Filed: Dec. 18, 1997

[51] Int. Cl.[6] ..... G10H 1/32; G10H 3/00

[52] U.S. Cl. ..... 84/743

[58] Field of Search ..... 84/743

[56] References Cited

U.S. PATENT DOCUMENTS

| | | |
|---|---|---|
| 3,688,011 | 8/1972 | Yamamoto . |
| 3,696,698 | 10/1972 | Kaminsky . |
| 3,796,122 | 3/1974 | Kaminsky . |
| 3,908,503 | 9/1975 | Bolin ..... 84/743 |
| 3,983,777 | 10/1976 | Bartolini . |
| 4,010,668 | 3/1977 | Plueddemann . |
| 4,057,688 | 11/1977 | O'Brien et al. . |
| 4,289,929 | 9/1981 | Hathaway . |
| 4,362,079 | 12/1982 | Kelly . |
| 4,535,668 | 8/1985 | Schaller . |
| 4,567,805 | 2/1986 | Clevinger . |
| 4,850,452 | 7/1989 | Wolcott . |
| 5,123,326 | 6/1992 | Clevinger . |
| 5,206,464 | 4/1993 | Lamm et al. . |
| 5,247,129 | 9/1993 | Nozaki et al. . |
| 5,524,061 | 6/1996 | Mooney et al. . |
| 5,649,020 | 7/1997 | McClurg et al. . |

*Primary Examiner*—Jeffrey Donels
*Attorney, Agent, or Firm*—Mathew R. P. Perrone, Jr.

[57] ABSTRACT

A sound replicating device has an electro-mechanically driven sound board mounted therein. The sound replicating device as well as the electro-mechanically driven sound board may be adapted for each particular resonator board of an instrument.

16 Claims, 8 Drawing Sheets

ELECTRO-MECHANICALLY DRIVEN SOUND BOARD

This invention relates to a sound replicating device for a stringed instrument and more particularly to a electro-mechanically driven sound board mounted in the sound replicating device, being especially suitable for use with a stringed instrument, which thereby more accurately reproduces the sound the stringed instrument in a large volume area.

BACKGROUND OF THE INVENTION

History shows that stringed instruments provide a very popular form of music. Some of these stringed instruments use sound boards, which is a substantially solid material usually made of wood. Typical of these instruments; which use a sound board; are a guitar, a violin, a cello, a bass fiddle, a viola, a mandolin, a harpsichord and a ukelele. Other stringed instruments may also use a sound board.

These instruments have a pleasing sound due to the vibration of the sound board. Resonance is transferred to the sound board by the vibration of the strings. Because the resonance of the wood in the form of a sound board within the instrument produces a unique sound, it is extremely difficult to efficiently and accurately amplify the sound of a stringed instrument.

Other stringed instruments produce sound with a flexible sound medium, wherein the string vibration causes vibration of the sound medium. A typical instrument in this class is a banjo. It is also difficult to amplify instruments of this class.

These stringed instruments are very effective and very powerful in a small room setting. However, they cannot always be played in a small room setting. It is sometimes very desirable to play one or more of these instruments in a large auditorium. In this case, the sound of the instrument must amplified.

The desire to connect a stringed instrument to an amplifying device usually requires an electronic pickup to be inserted in the instrument. This electronic pickup goes to a sound replicating device. The sound replicating device receives the sound from the instrument and permits it to be hear throughout the auditorium.

Such transfer of the sound from the instrument implicating is not consistently good. While it is not desired to be bound by any particular theory, there is a postulate, which may explain the replicating deficiency. The postulate is based on the structure of the sound replicating device. The loss of total quality of the stringed instrument is believed to be caused by the inability of the speaker to duplicate the sound vibrations of the sound board of the instrument involved.

No good method or structure is known to overcome these problems of amplification of stringed instruments. As such, a stringed instrument can lose its impact before a large audience, in a large auditorium or similar room. This loss of impact is clearly due to a lack of faithful reproduction of the instrument sound.

This sound board, as contained in the instrument, makes the instrument very suitable for a small venue, where the instrument can be heard directly. In a larger venue, it is sometimes required to amplify the sound. The amplification loses the second quality in that the resonance of the sound board in the instrument cannot be accurately duplicated.

Various attempts have been made to overcome this feature. Sometimes an electronic pick-up device is put right in the instrument. This electronic pick-up device is then fed to an amplifier. The amplifier, in turn, feeds a speaker for the purpose of making the instrument to be heard throughout the desired hearing area.

Such electronic replication of the instrument does not permit the actual sound of the vibration of the board to be produced. It is very desirable to produce this actual sound based on the vibration of the wood in the sound board of the instrument. However, no effective mechanism for achieving the same is no known.

SUMMARY OF THE INVENTION

Among the many objectives of this invention is the provision of a electro-mechanically driven sound board capable of accurately reproducing the sound of a stringed instrument.

A further objective of this invention is to provide a sound replicating device having an electro-mechanically driven sound board mounted therein.

A still further objective of this invention is to provide a sound replicating device having an electro-mechanically driven sound board, with a size adapted to the size of a sound board in an instrument.

Yet a further objective of this invention is to provide a sound replicating device having an electro-mechanically driven sound board, with a appropriate sound pick up for a stringed instrument.

Also an objective of this invention is to provide a sound replicating device having an electro-mechanically driven sound board, with a resonator board related to the size of a sound board in an instrument.

Another objective of this invention is to provide a method for accurately reproducing the sound of stringed instrument with an electro-mechanically driven sound board therein.

Yet another objective of this invention is to provide a method for adapting an electro-mechanically driven sound board for a stringed instrument.

These and other objectives of the invention (which other objectives become clear by consideration of the specification, claims and drawings as a whole) are met by providing a sound replicating device having an electro-mechanically driven sound board mounted therein. The sound replicating device as well as the electro-mechanically driven sound board may be adapted for each particular resonator board of an instrument.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
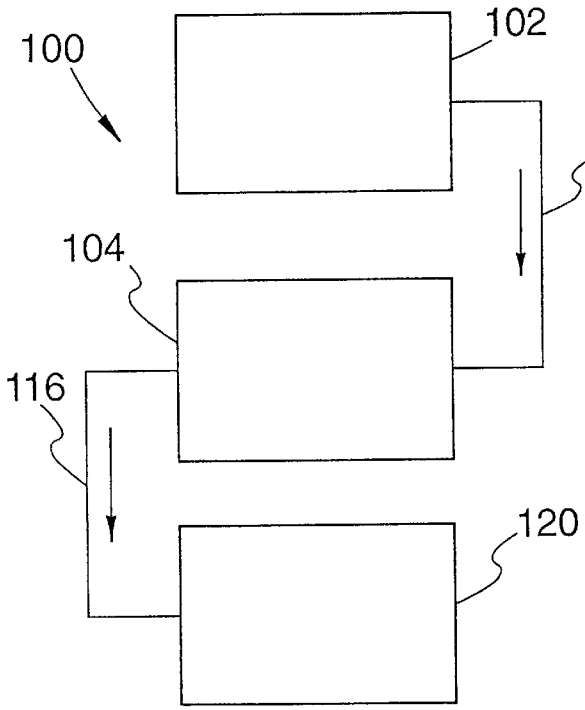
FIG. 1 depicts a box diagram 100 of a stringed instrument 102 connected to an amplifier 104, which is in turn connected to the sound replicating device 120.

This invention relates to an electro-mechanically driven sound board mounted in a sound replicating device for use with a stringed instrument. The stringed instrument usually has a resonator board. A connection between the stringed instrument and the sound replicating device permits the stringed instrument to activate the electro-mechanically driven sound board.

This electro-mechanically driven sound board becomes, in effect, a remote or an auxiliary instrument, which has the capability of reproducing the nuance and timbre of the original instrument in an extremely accurate fashion. While it is not desired to be bound by any particular theory, a possible postulate, explaining the effectiveness of the electro-mechanically driven sound board, relates to it being of the same material as the sound mechanism in the original instrument. However, this device has the capacity for much greater volume, because it does not have to also withstand the immense tension on the strings, which limits an instrument's potential.

The sound replicating device, which includes the electro-mechanically driven sound board, is based on a modified speaker assembly having a electro-mechanically driven sound board mounted therein. Accuracy in the sound reproduction comes from the vibration of the electro-mechanically driven sound board.

Preferably, the size of the sound replicating device is adapted to receive a electro-mechanically driven sound board about the size of the sound board in an instrument. In this electro-mechanically driven sound board, the resonator board is activated by a modified speaker. This sound particular speaker has a electro-mechanically driven sound board of similar size to the instrument being used, such that the electronic set up the speaker simply vibrates the electro-mechanically driven sound board in the same manner as the stroking of the string vibrates the resonator board in the instrument. In this fashion with the electro-mechanically driven sound board being so positioned, the desired vibration can be achieved, and the sound more accurately amplified.

An electro-mechanically driven sound board may have different sizes and shapes depending on the instrument with which it is used. These various sizes and shapes may include flat, arched or carved; with or without bracing, and with or without sound holes of various shapes. Typical materials for the electro-mechanically driven sound board may be flexible or solid. The solid materials are, however, capable of vibrating in order to produce sound. Typical materials include wood, metal, a synthetic sheet or fabric, or a natural sheet or fabric.

This material may be attached to the front of variously sized and shaped enclosures. The electro-mechanically driven sound board may be driven by means of a direct mechanical link to an electro-mechanical driver for the purpose of remotely simulating, reproducing and amplifying the sounds of various stringed instruments by means of a pick-up in said instrument and an amplifier, though it need not be limited to those applications.

The shape of an electro-mechanically driven sound board for a guitar (for instance) can be shaped like either a guitar with corresponding shaped enclosure, or a square attached to a box. The shape is not the material reason for the accurate amplified replication of the sound. While it is still not desired to be bound by any particular postulate for the effectiveness of the electro-mechanically driven sound board of this invention, it is believed that the actual act of driving a sound board with an electro-mechanical driver, which is, in turn, driven by an amplifier, cause the amplification with great accuracy the sound of an instrument—regardless of the shape of the sound board.

The structure of an electro-mechanically driven sound board is important for reproducing authentic sounds. Some will be flat (like a flat top guitar). Some may be curved to an arch (like a mandolin or a jazz guitar). Some may or may not be braced depending on the power to be applied to or the over-all size of the sound board.

The size and shape of holes in the electro-mechanically driven sound board adds visual appeal, bass and presence and helps in the overall reproduction of the original instrument's sound but can be accomplished by porting the enclosure by other means and is not a main object of this invention. In some situations, the device is successful with no apertures.

The electro-mechanically driven sound board employed to enhance a guitar, mandolin, violin, cello, bass, piano, harpsichord or other wooden soundboard stringed instrument is likely to be made of spruce, cedar, redwood or other wood commonly used in those instruments. The material is, however, not necessarily limited to wood.

The size of such devices are probably, but not necessarily in proportion to the instrument to be enhanced. It is preferred that the size of instrument soundboard substantially correspond to the size electro-mechanically driven sound-board in terms of area and thickness. If such is not possible, much can be done with tonal equalization from the amplifier.

The electro-mechanically driven sound-board employed to enhance a guitar or other instrument of the DOBRO class can be a DOBRO resonator cone with an appropriate enclosure. DOBRO is a registered trademark current owned by the Gibson Guitar Corporation of Nashville, Tenn. The electro-mechanically driven sound-board employed to enhance a banjo can be a banjo head with an appropriate enclosure.

The means by which the electro-mechanical driver is attached to the sound board is a direct mechanical link between the voice coil of the electro-mechanical driver and the soundboard. The driver itself may be made of aluminum, plastic, wood, graphite epoxy; or alternate materials; or combinations of the same. The direct link is accomplished with glue, a nut and bolt assembly or other mechanical device. The actual act of driving the soundboard by means of a direct link to an electro-mechanical driver, which is driven by an amplifier.

Referring now to FIG. 1, in box diagram 100, a stringed instrument 102 is shown as connected to an amplifier 104, which is in turn connected to the sound replicating device 120. Stringed instrument 102 is preferably any stringed instrument having a resonator board.

Typical of a stringed instrument 102, which uses a resonator board, is a guitar, a violin, a harp, a cello, a bass fiddle, a viola, a mandolin or a ukelele. Other stringed instruments may also use a sound board. Another stringed instrument, such as a banjo, which uses a cloth, leather, or other flexible sound medium, may also use this sound replicating device 120, with a similar electro-mechanically driven sound device mounted therein.

Figure 2:
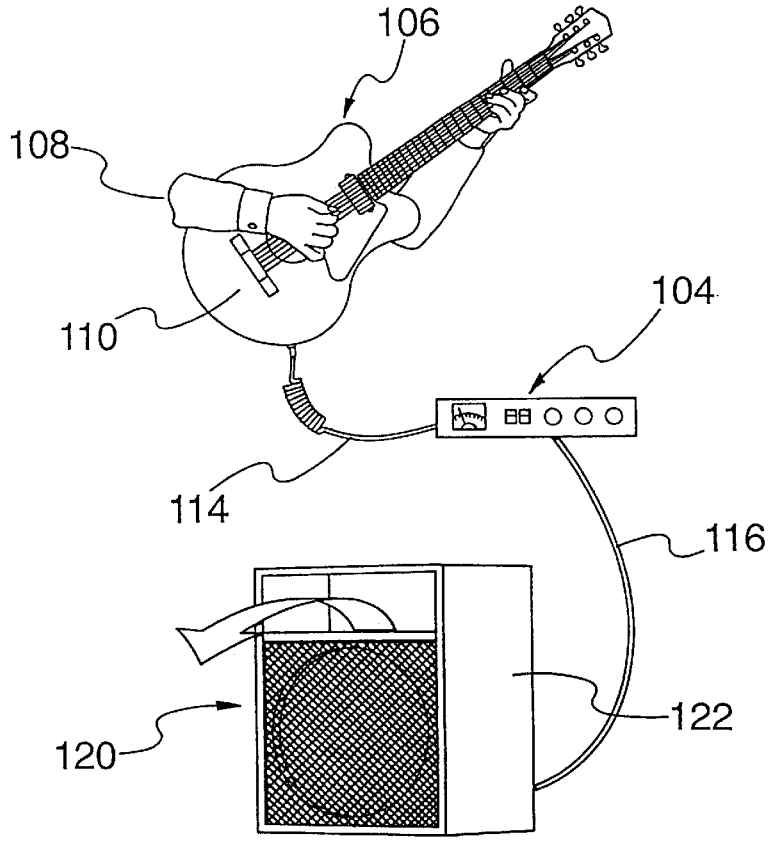
FIG. 2 depicts a guitar 106 being played by a human being 108, which is connected to amplifier 104, which is, in turn, connected to the sound replicating device 120 having the electro-mechanically driven sound board 182 of this invention.

In FIG. 2, a guitar 106 is depicted as being played by a human being 108. The guitar sound board 110 in guitar 106 is electronically connected to an amplifier 104 through an amplifier cord 114, in a standard fashion. The amplifier 104 is connected by the sound replicating cords 116 to the sound replicating device 120.

The guitar sound board 110 of guitar 106 and the amplifier 104 are standard pieces of equipment. The sound replicating device 120 of this invention is based on a modification of a speaker assembly. A speaker assembly includes a speaker cabinet, which is similar in outward appearance to cabinet 122. Mounted in speaker cabinet 122 is a magnetically operated speaker (not shown).

Figure 3:
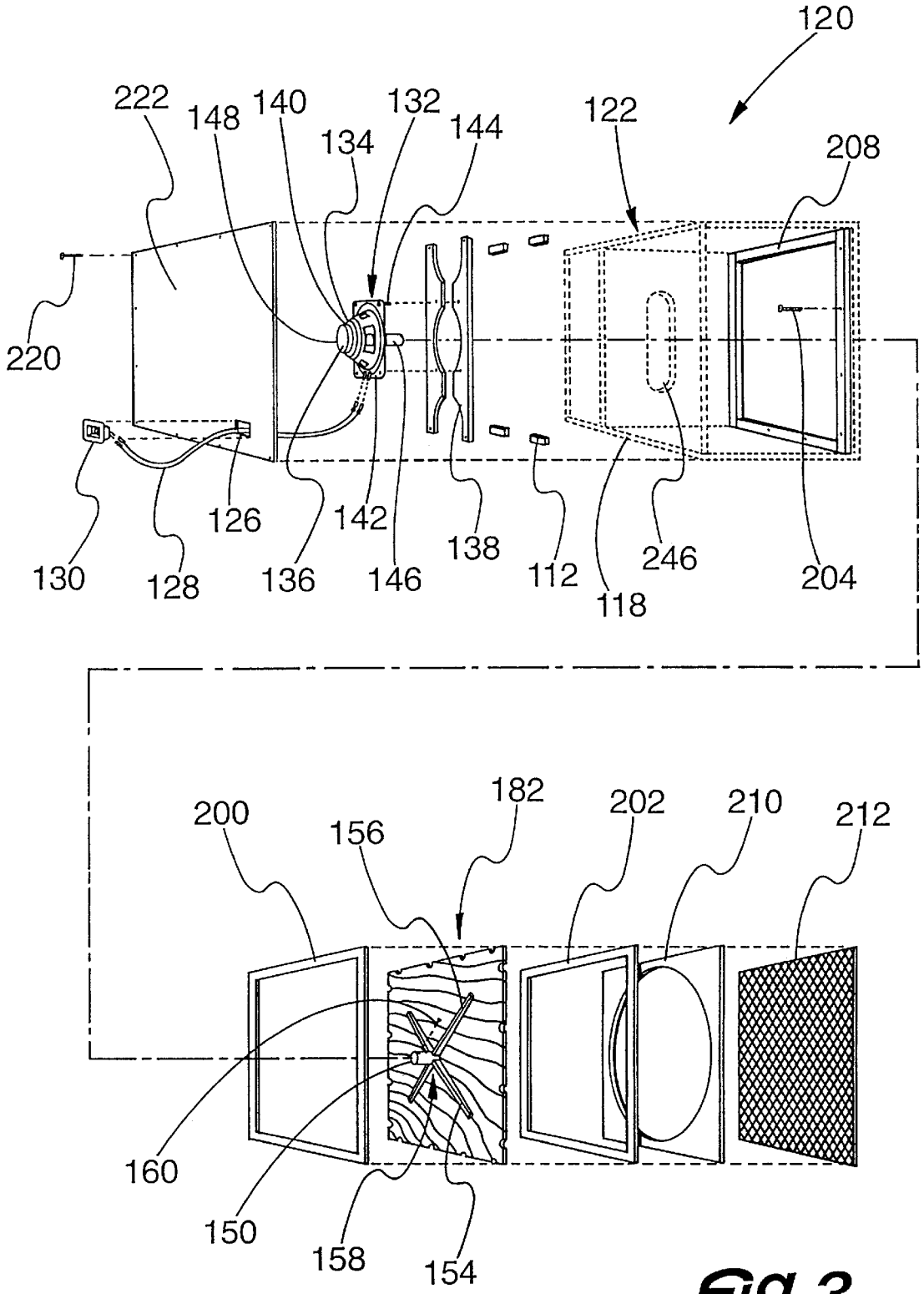
FIG. 3 depicts a bottom, perspective, exploded view of the sound replicating device 120 having the electro-mechanically driven sound board 182 of this invention.

Referring now to FIG. 3, an exploded view of the sound replicating device 120 is depicted. The sound replicating device 120 includes a cabinet 122. The cabinet 122 is of a hollow rectangular shape. Mounted on the cabinet 122 is the cabinet back 124. In the cabinet back 124, is a wire aperture 126 for the conductor wire 128 to receive the sound replicating cords 116.

Figure 4:
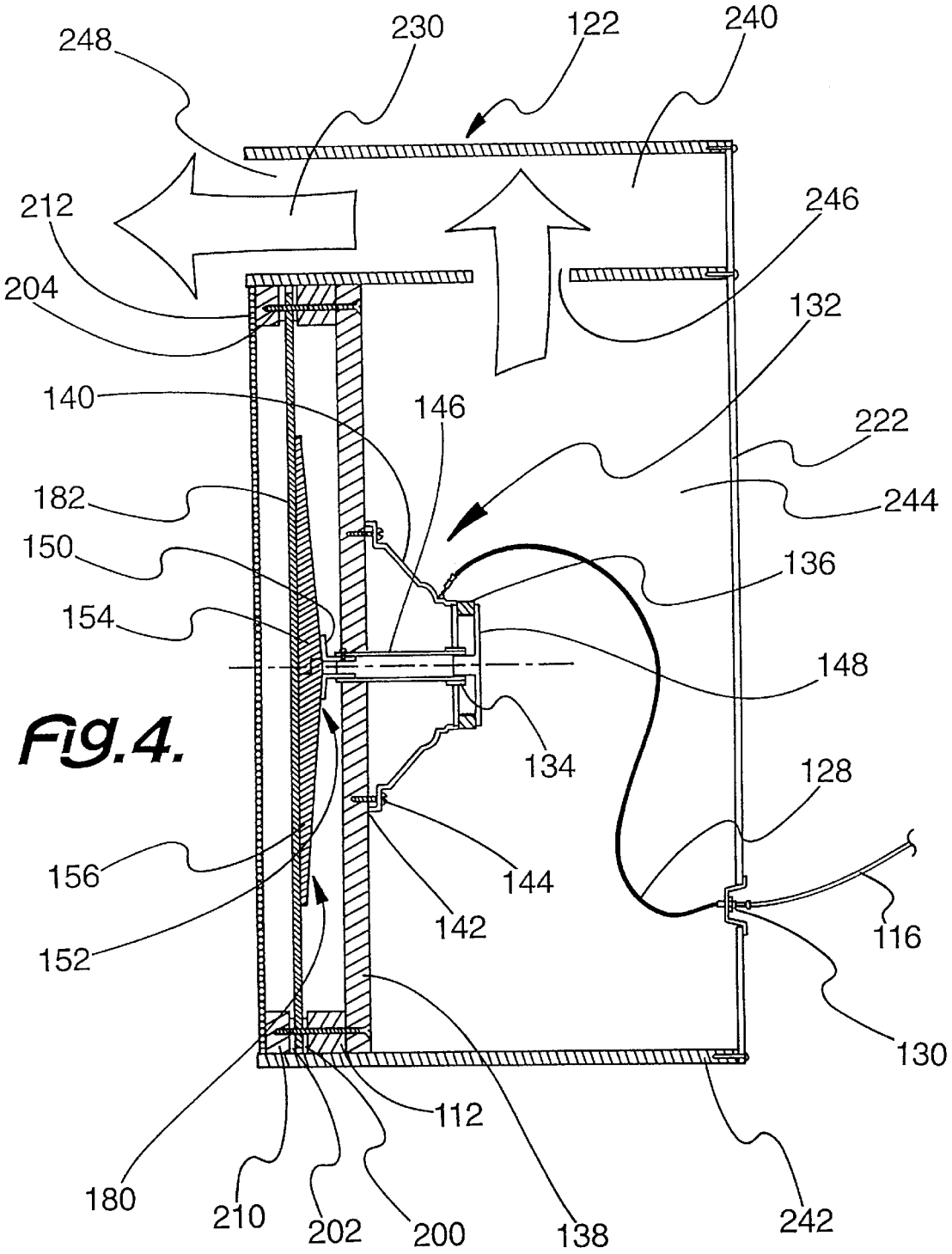
FIG. 4 depicts a side, cross-sectioned view of the sound replicating device 120 having the electro-mechanically driven sound board 182.

Adding FIG. 4 to the consideration, a phone jack 130 connects the conductor wire 128 to the sound replicating cords 116. The conductor wire 128 is connected to the exciter 132. The exciter 132 pulses with the different current passing through the sound replicating cords 116 and serves to operate an electro-magnet 134 in combination with a permanent magnet 136.

The exciter 132 is mounted on a support board 138, within cabinet 122. The support board 138 is spaced from the electro-mechanically driven sound board assembly 180. The exciter 132 includes a hollow, truncated cone 140. Cone base 142 is secured to support board 138 by cone screws 144 or another appropriate fastening mechanism.

Figure 5:
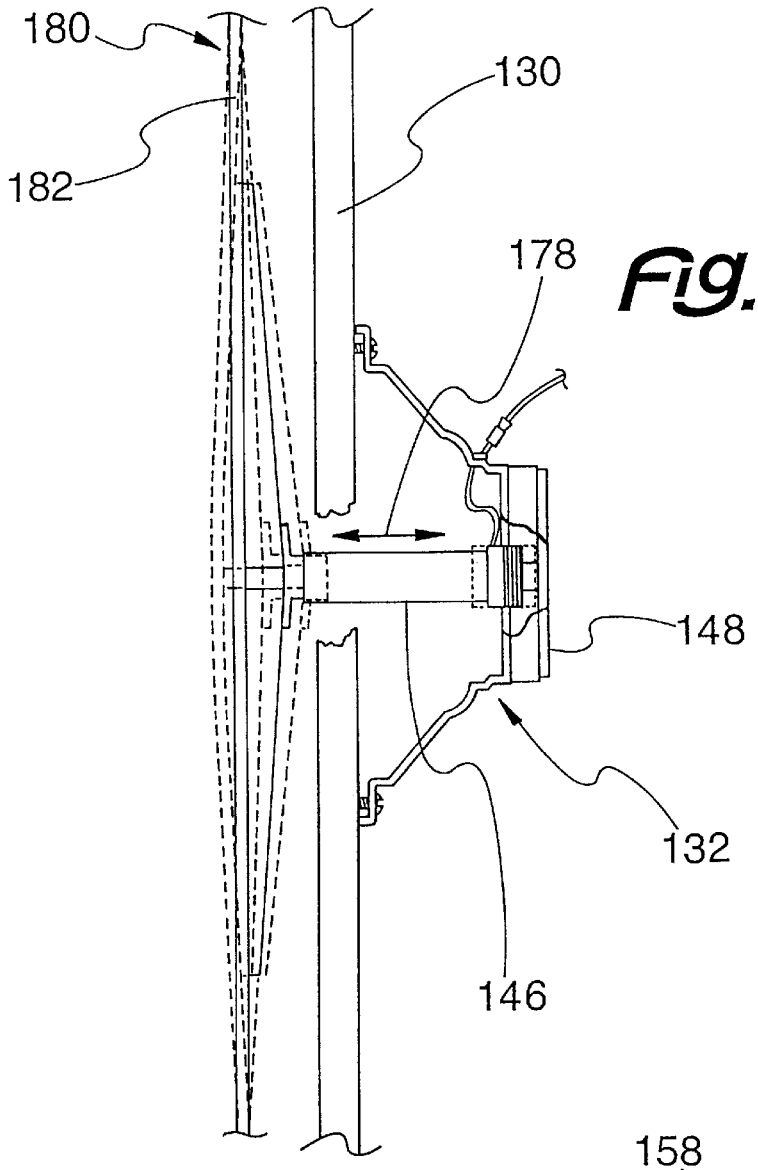
FIG. 5 depicts a side view of the exciter mount assembly 130.
Figure 6:
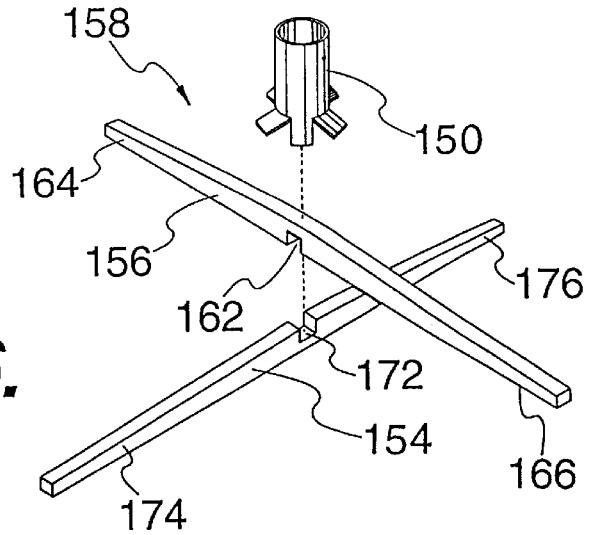
FIG. 6 depicts a perspective, exploded view of the dovetailed brace assembly 158.

Adding FIG. 5 and FIG. 6 to the consideration, driver tube 146 extends from truncated cone top 148 to a coupling flange 150. Coupling flange 150 is connected to rib assembly 152 and lower rib 154 in particular, thereby connecting driver tube 146 to electro-mechanically driven sound board 182. Upper rib 156 has a dove-tail assembly 158 with lower rib 154.

Upper rib 156 is arcuate with an upper central notch 162 centrally located therein. A first upper arm 164 extends from one side of the upper central notch 162. A second upper arm 166 is oppositely disposed from first upper arm 164 and extends from the opposing side of the upper central notch 162.

Likewise lower rib 154 is arcuate with a lower central notch 172 centrally located therein. A first lower arm 174 extends from one side of the lower central notch 172. A second lower arm 172 is oppositely disposed from first lower arm 174 and extends from the opposing side of the lower central notch 172.

Preferably electro-mechanically driven sound board assembly 180 is formed by gluing or pressure securing of lower rib 154 and upper rib 156 to the electro-mechanically driven sound board 182. This permits a structure in sound replicating device 120 similar to that of the desired instrument, and provides for more efficient and more aesthetically pleasing reproduction of sound.

More specifically, the coupling flange 150 connects upper rib 156 and lower rib 154 and provides the support for the sound replicating or electro-mechanically driven sound board 182 with the driver tube 146 of exciter 132 and provides for the activation or pulsing of the electro-mechanically driven sound board 182 by the exciter 132.

Figure 7:
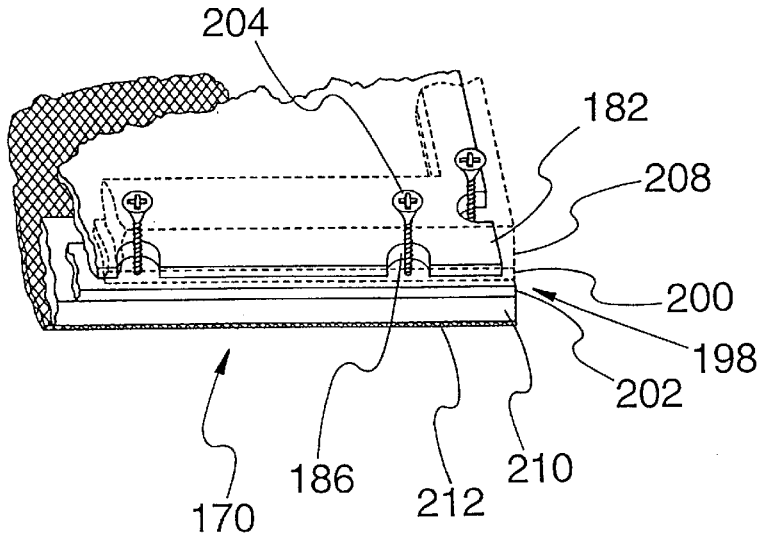
FIG. 7 depicts a perspective view of the electro-mechanically driven sound board assembly 180.

In FIG. 7 is depicted a perspective view of the electro-mechanically driven sound board 182, at the edge 162 thereof. The support board 138 is spaced from the sound replicating board 182. The sound replicating board 182 is surrounded by a gasket assembly 198. Gasket assembly 198 includes a back gasket 200 and a front gasket 202. Both back gasket 200 and front gasket 202 are preferably formed from cork. Other resilient material may also be operable.

Gasket screws 204 hold back retainer frame 208 and front retainer frame 210 together. Adjacent to back retainer frame 208 is back gasket 200. Adjacent to front retainer frame 210 is front gasket 202. Between front gasket 202 and back gasket 200 is electro-mechanically driven sound board 182, held in position by gasket screws 204.

To repeat, the front retainer frame 210 fits over the front gasket 202 and may be covered by a front protective grill 212, both being attached in a standard fashion. The electro-mechanically driven sound board 182 is clearly shown as spaced and pinned between the back gasket 200 and front gasket 202. There is contact of electro-mechanically driven sound board 182 with gasket 186, but not with gasket screws 204 or any other screws. The cabinet screws 220 fix the back plate 222 on the backside 118 of cabinet 122 without having an adverse effect on the sound produced by the sound replicating device 120.

Referring back to FIG. 2 and FIG. 4, the cabinet 122 preferably includes a backside sound delivery 230. On the cabinet 122 is an upper hollow rectangle 240 above the electro-mechanically driven sound board 182 which permits sound to proceed upwardly and out of the cabinet 122 for better sound delivery. This is formed in the cabinet 122 as an upper part of the cabinet 122, which is within the frame 242. The frame 242 of the cabinet 122 includes the lower spacing 244 with a spacing aperture 246 therein to permit the flow of the sound therethrough out of top opening 248. Such a sound flow increases the sound aesthetics of the sound replicating device 120.

Figure 8:
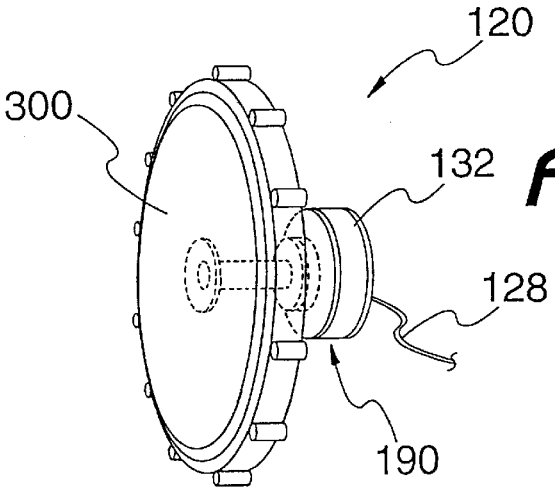
FIG. 8 depicts a partial perspective view of the sound replicating device 120 having the electro-mechanically driven flexible head 300.

In FIG. 8, the sound replicating device 120 has the electro-mechanically driven flexible head 300. The exciter mount assembly 190 may be glued or otherwise secured to the flexible head 300.

Figure 9:
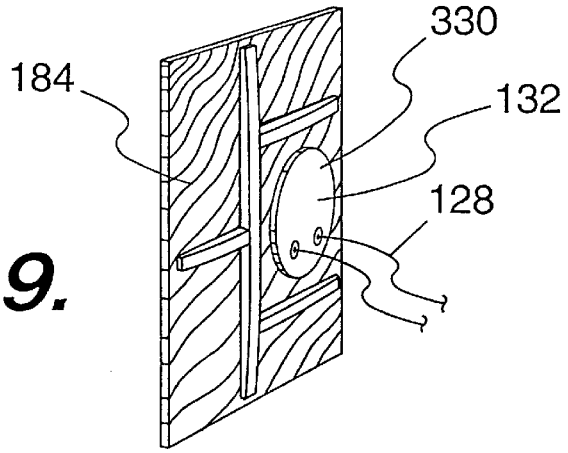
FIG. 9 depicts a rear perspective view of the electro-mechanically driven sound board 182 using a piezo electric crystal element 330.

In FIG. 9, a rear perspective view of the alternative sound board 184 shows the alternative use of a piezo electric crystal element 330. The piezo electric elements are commonly used as beepers in smoke alarms, computers, and games; and as tweeters in audio systems. They inherently exhibit high impedance (typically 1 million ohms). When the output impedance of an audio amplifier 104 is matched to the impedance of piezo electric crystal element 330, it may also serve as a full-range speaker element and effectively drive the sound board 182, no matter what its shape or size.

Figure 10:
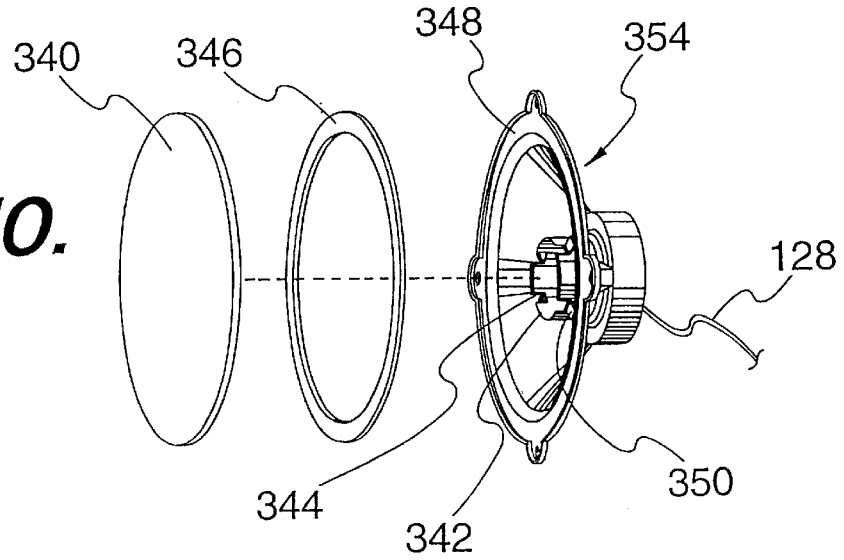
FIG. 10 depicts a front, perspective, exploded view of the sound replicating device 120 having the electro-mechanically driven sound board 182 of this invention using a circular board 340.
Figure 11:
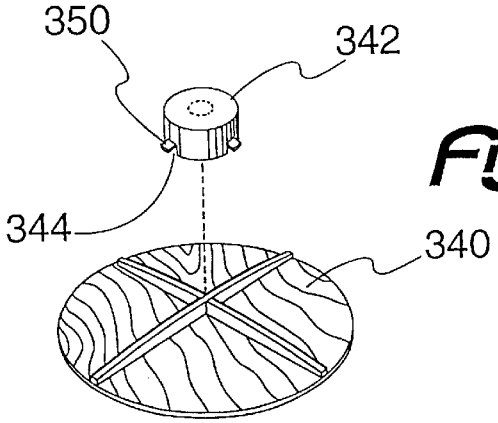
FIG. 11 depicts a rear, perspective, exploded view of circular board 340 with rib assembly 152 and voice coil assembly 342.
Figure 12:
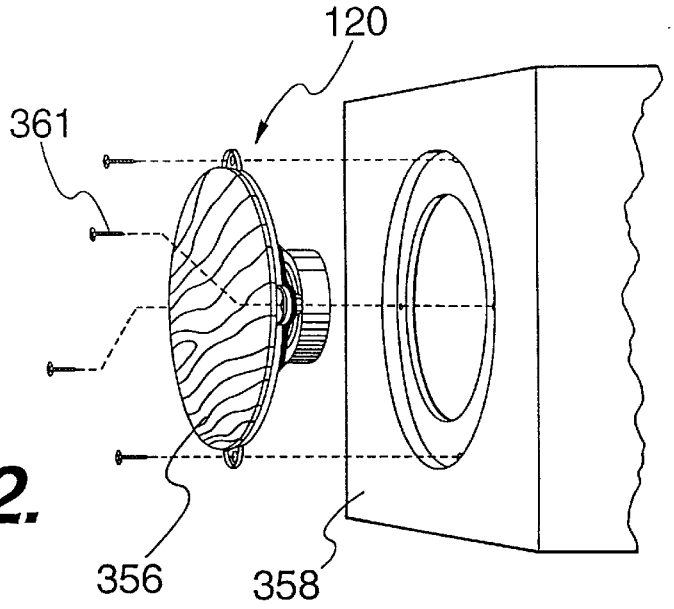
FIG. 12 depicts a front, perspective, exploded view of the sound replicating device 120 of FIG. 10 with cabinet 122.

In FIG. 10, FIG. 11 and FIG. 12, a front, perspective, exploded view of the sound replicating device 120 having the electro-mechanically driven circular sound board 340. Circular board 340 uses a voice coil extension 342 having brace slots 344 and attachment brackets 350, fastened to rib assembly 152 by bracket screws 352. Voice coil extension 342 thus connects circular soundboard 340 in sound replicating device 120. The circular sound board 340 is held in a resonance attitude by adhesion to the circular gasket 346, which is also held by adhesion to the gasket cradle 348 of the conventional speaker frame 354. Circular sound board 340 is also adapted to have the area and thickness of the desired instrument sound board. The circular sound board 340 is mounted to cabinet 358 as a speaker using circular mount screws 361.

Figure 13:
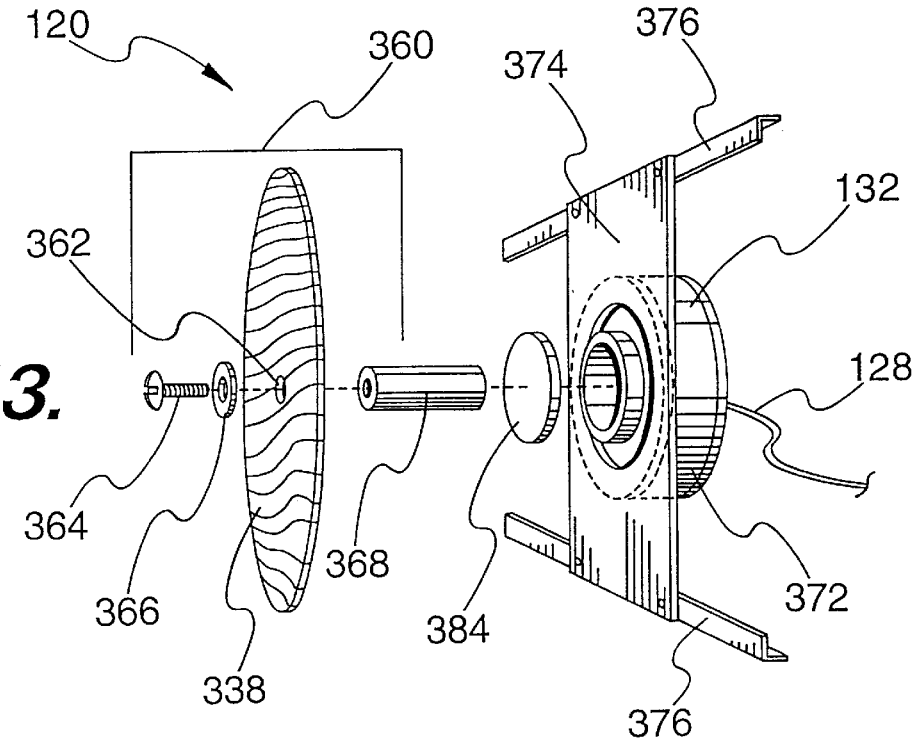
FIG. 13 depicts a front, perspective, exploded view of the sound replicating device 120 having the electro-mechanically driven sound board 182 of this invention with a screw assembly 360.

By considering FIG. 13, a screw assembly 360 holds circular sound board 340 in the sound replicating device 120 without the bracing rib assembly of FIG. 12. Circular sound board 340 is modified to have a central aperture 362 to receive screw assembly 360. A threaded screw 364 fits through a washer 366 and then central aperture 362 into threaded relation driven piston 368. Driver disk 384 is secured, in a standard fashion, to both driven piston 368 and voice assembly 372 by welding or another suitable method.

Voice coil 372 is supported by its pair of mounting flanges 374. Mounting flange 374 is mounted in cabinet 122 using a pair of mounting brackets in a standard fashion. Cabinet 122 is then assembled into a sound replicating device such device 120.

Figure 14:
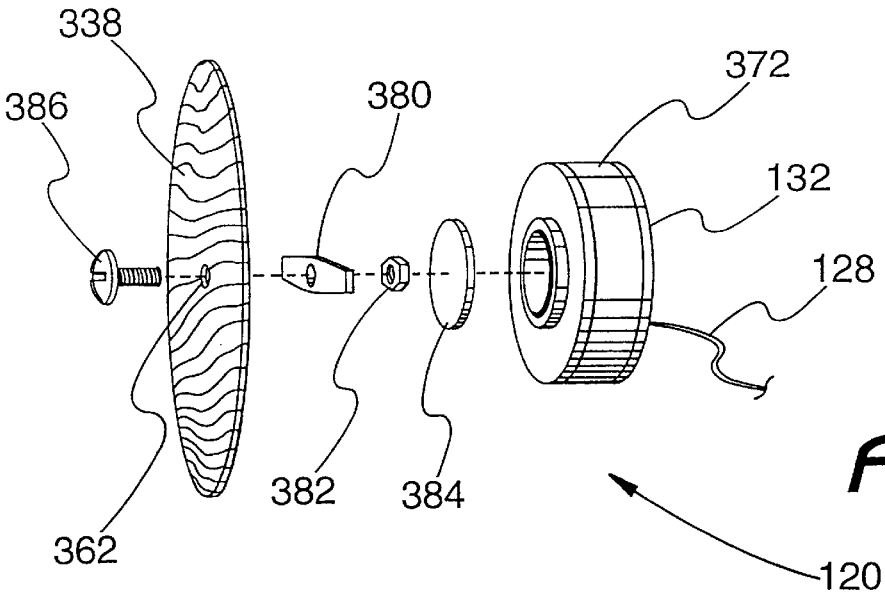
FIG. 14 depicts a front, perspective, further exploded view of FIG. 12.

FIG. 14 depicts a further modification, especially of FIG. 13. FIG. 14 differs from FIG. 13 by replacing driver piston 368 with soundboard brace 380 held in place by lock nut 382. Driver disk 384 is secured to both lock nut 382 and voice coil 372. Thus, circular sound board 338 forms another version of the electro-mechanically driven sound board 182 of this invention with a screw assembly 360.

Figure 15:
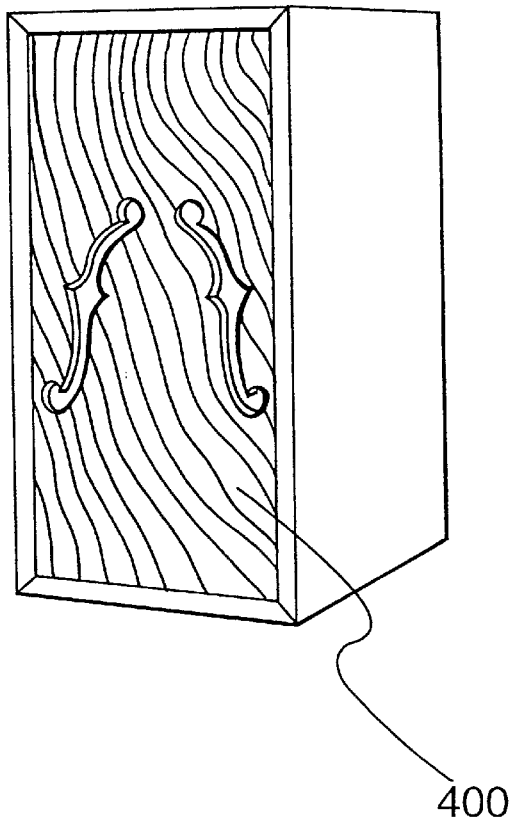
FIG. 15 depicts a front, perspective, view of a base cabinet 400 using electro-mechanically driven sound board 182 in sound replicating device 120.
Figure 16:
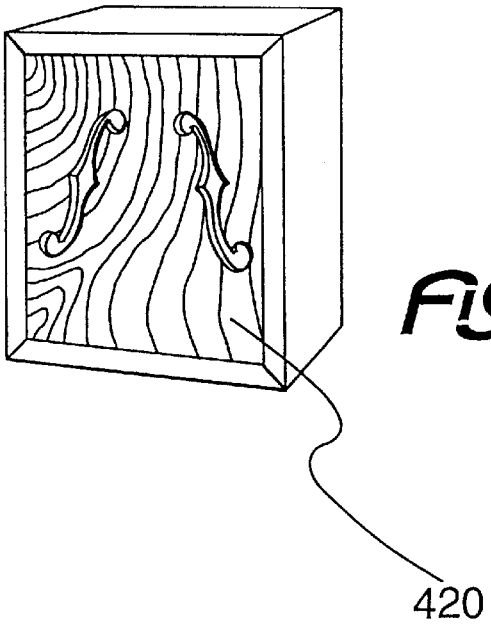
FIG. 16 depicts a front, perspective, view of a violin cabinet 420 using electro-mechanically driven sound board 182 in sound replicating device 120.

The combination of FIG. 15 and FIG. 16 show the difference between a bass cabinet 400 (FIG. 15) and a violin cabinet 420 (FIG. 16) depicts a front, perspective, view of a violin cabinet 420 using electro-mechanically driven sound board 182 in sound replicating device 120. The different sizes of bass cabinet 400 and violin cabinet 420 provide for an appropriate soundboard for the desired instrument. A series of sound replicating devices 120 may be used depending on the size of the auditorium and the variety of instruments being played.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An amplifying assembly for a stringed instrument, the stringed instrument having a resonator board therein, comprising a sound replicating device and an amplifier, the amplifying assembly comprising:

(a) the sound replicating device having an electro-mechanically driven sound board mounted therein;

(b) the electro-mechanically driven sound board having a size related to a size for the resonator board of the stringed instrument;

(c) the amplifier including a connecting means for connection of the amplifier between the sound replicating device and the stringed instrument;

(d) the sound replicating device forming a part of a modified speaker assembly having the electro-mechanically driven sound board mounted therein;

(e) the sound replicating device including a receiving means for receiving the electro-mechanically driven sound board;

(f) the sound replicating device including a vibrating means for vibrating the electro-mechanically driven sound board as a result of stroking at least one string on the stringed instrument;

(g) the electro-mechanically driven sound board having a shape selected from the group consisting of flat, arched and curved;

(h) the electro-mechanically driven sound board having a braced or braceless support; and (i) the electro-mechanically driven sound board being formed of a material selected from the group consisting of a flexible material and a solid material.

2. The amplifying assembly of claim 1 further comprising the electro-mechanically driven sound board being formed of wood.

3. The amplifying assembly of claim 1 further comprising the electro-mechanically driven sound board being formed of an electro-mechanically driven flexible head.

4. The amplifying assembly of claim 3 further comprising:

(a) the electro-mechanical driver having a voice coil;

(b) the voice coil having a fastening means for attaching the voice coil to the electro-mechanically driven sound board; and (c) the electro-mechanical driver being drivable by the amplifier.

5. The amplifying assembly of claim 4 further comprising:

(a) the sound replicating device including a cabinet;

(b) the cabinet including a hollow shape for receiving the electro-mechanically driven sound board;

(c) a cabinet back for the cabinet closing the hollow shape;

(d) a support board being mounted in the cabinet;

(e) the electro-mechanically driven sound board being mounted in the cabinet;

(f) an exciter means being mounted on the support board;

(g) the electro-mechanically driven sound board being spaced from the support board;

(h) a connecting means joining the exciter means to the electro-mechanically driven sound board; and (i) the exciter means being connectable to the stringed instrument in order to permit the electro-mechanically driven sound board to be activated as the instrument is played.

6. The amplifying assembly of claim 5 further comprising:

(a) the exciter means including a hollow, truncated cone;

(b) the hollow, truncated cone having a cone base and a cone top;

(c) the cone base being secured to the support board; and (d) a coupling flange extending from the cone top;

(e) the coupling flange being secured to the electro-mechanically driven sound board.

7. The amplifying assembly of claim 6 further comprising:

(a) a rib assembly being secured to the electro-mechanically driven sound board;

(b) the rib assembly being at least partially between the electro-mechanically driven sound board and the coupling flange.

8. The amplifying assembly of claim 7 further comprising:

(a) the rib assembly including an upper rib and a lower rib;

(b) a driver tube being positioned between the rib assembly and the driving means; and (c) the coupling flange being connected to the rib assembly, thereby connecting the driver tube to the electro-mechanically driven sound board.

9. The amplifying assembly of claim 8 further comprising the stringed instrument being at least one selected from the group consisting of a guitar, a violin, a cello, a base fiddle, a viola, a mandolin, a harpsichord, a ukelele, and a banjo.

10. A sound replicating device comprising:

(a) a cabinet providing a support for the sound replicating device;

(b) an electro-mechanically driven sound board for the sound replicating device being mounted in the cabinet;

(c) a mounting assembly supporting electro-mechanically driven sound board in the cabinet;

(d) the electro-mechanically driven sound board having a size about the same as a size of the resonator board in a stringed instrument;

(e) the sound replicating device being based on a modified speaker assembly having the electro-mechanically driven sound board mounted therein;

(f) the sound replicating device receiving the electro-mechanically driven sound board;

(g) the sound replicating device vibrating the electro-mechanically driven sound board in a manner similar to a stroking of at least one string on the stringed instrument;

(h) the electro-mechanically driven sound board having a shape selected from the group consisting of flat, arched and curved;

(i) the electro-mechanically driven sound board having a braced or braceless support;

(j) the electro-mechanically driven sound board being formed of a material selected from the group consisting of a flexible material and a solid material;

(k) the electro-mechanically driven sound board having a driving means attached thereto;

(l) the driving means causing a vibration in the electro-mechanically driven sound board as the musical instrument is played;

(m) the driving means including a direct mechanical link and an electro-mechanical driver; and (n) the direct mechanical link being connected to the electro-mechanical driver in order to remotely simulate, reproduce or amplify a sound from the stringed instrument.

11. The sound replicating device of claim 10 further comprising:

(a) the sound replicating device vibrating the electro-mechanically driven sound board in a manner similar to a stroking of at least one string on the stringed instrument;

(b) the electro-mechanically driven sound board having a shape selected from the group consisting of flat, arched and carved;

(c) the electro-mechanically driven sound board having a braced or braceless support;

(d) the electro-mechanically driven sound board being formed of a material selected from the group consisting of a flexible material and a solid material;

(e) the electro-mechanically driven sound board having a driving means attached thereto; and (f) the driving means causing a vibration in the electro-mechanically driven sound board as the musical instrument is played;

(g) the driving means including a direct mechanical link and an electro-mechanical driver; and (h) the direct mechanical link being connected to the electro-mechanical driver in order to remotely simulate, reproduce or amplify a sound from the stringed instrument.

12. The sound replicating device of claim 10 further comprising:

(a) the electro-mechanical driver having a voice coil;

(b) the voice coil having a fastening means for attaching the voice coil to the electro-mechanically driven sound board;

(c) the electro-mechanical driver being driven by the amplifier;

(d) the sound replicating device including a cabinet;

(e) the cabinet including a hollow shape to receive the electro-mechanically driven sound board;

(f) a cabinet back for the cabinet to close the hollow shape;

(g) a support board being mounted in the cabinet;

(h) the electro-mechanically driven sound board being mounted in the cabinet;

(i) an exciter means being mounted on the support board;

(j) the electro-mechanically driven sound board being spaced from the support board;

(k) a connecting means joining the exciter means to the electro-mechanically driven sound board; and (i) the exciter means being connected to the stringed instrument in order to permit the electro-mechanically driven sound board to be activated as the instrument is played.

13. The sound replicating device of claim 12 further comprising:

(a) the exciter means including a hollow, truncated cone;

(b) the hollow, truncated cone having a cone base and a cone top;

(c) the cone base being secured to the support board;

(d) a coupling flange extending from the cone top;

(e) the coupling flange being secured to the electro-mechanically driven sound board;

(f) a rib assembly being secured to the electro-mechanically driven sound board; and (g) the rib assembly being at least partially between to the electro-mechanically driven sound board and the coupling flange.

14. The sound replicating device of claim 13 further comprising:

(a) the rib assembly including an upper rib and a lower rib;

(b) a driver tube being positioned between the rib assembly and the driving means;

(c) the coupling flange being connected to the rib assembly, thereby connecting the driver tube to the electro-mechanically driven sound board;

(d) the upper rib and the lower rib being connected in dovetail assembly; and (e) the coupling flange being connected to the rib assembly, thereby connecting driver tube to the electro-mechanically driven sound board.

15. The sound replicating device of claim 14 further comprising:

(a) the upper rib being arcuate in shape;

(b) the upper rib having an upper central notch centrally located therein;

(c) the upper rib having a first upper arm extending from a first side of the upper central notch;

(d) the upper rib having a second upper arm oppositely disposed from the first upper arm and extending from an upper opposing side of the upper central notch;

(e) the lower rib being arcuate in shape;

(f) the lower rib having a lower central notch centrally located therein;

(g) the lower rib having a first lower arm extending from a first lower side of the lower central notch;

(h) a first lower arm extending from a first lower side the lower central notch; and (i) the lower rib having a second lower arm oppositely disposed from the first lower arm and extending from an lower opposing side of the lower central notch.

16. A sound replicating device comprising:

(a) a cabinet providing a support for the sound replicating device;

(b) an electro-mechanically driven sound board for the sound replicating device being mounted in the cabinet;

(c) the electro-mechanically driven sound board having a board size similar to a size of a resonator board in a stringed instrument;

(d) the sound replicating device being based on a modified speaker assembly having the electro-mechanically driven sound board mounted therein;

(e) the sound replicating device receiving the electro-mechanically driven sound board;

(f) a mounting assembly supporting the electro-mechanically driven sound board in the sound replicating device;

(g) the mounting assembly including a gasket assembly;

(h) the gasket assembly including a back gasket and a front gasket;

(i) the back gasket surrounding one side of the electro-mechanically driven sound board;

(j) the front gasket being mounted on the electro-mechanically driven sound board and oppositely disposed from the back gasket; and (k) the gasket assembly supporting the electro-mechanically driven sound board and provide all support therefor within the cabinet.

* * * * *